United States Patent [19]

Roy

[11] Patent Number: 5,046,405

[45] Date of Patent: Sep. 10, 1991

[54] AIR DIFFUSER

[76] Inventor: Michel Roy, 856 du Parc, Duvernay, Laval, Quebec, Canada, H7E 2T6

[21] Appl. No.: 646,367

[22] Filed: Jan. 28, 1991

[51] Int. Cl.[5] ..... F24F 13/06

[52] U.S. Cl. ..... 98/40.15; 98/40.17

[58] Field of Search ..... 98/40.05, 40.15, 40.16, 98/40.17

[56] References Cited

U.S. PATENT DOCUMENTS

| | | | |
|---|---|---|---|
| 2,433,981 | 1/1948 | Buck | 98/40.15 |
| 2,504,472 | 4/1950 | Van Alsburg et al. | 98/40.15 |
| 2,791,170 | 5/1957 | Phillips et al. | 98/40.15 |
| 3,854,386 | 12/1974 | Hedrick . | |
| 4,182,227 | 1/1980 | Roy | 98/40.15 |

FOREIGN PATENT DOCUMENTS

| | | | |
|---|---|---|---|
| 8704507 | 7/1987 | PCT Int'l Appl. | 98/40.05 |

*Primary Examiner*—Harold Joyce

*Attorney, Agent, or Firm*—Pierre Lespérance

[57] ABSTRACT

An air diffuser adapted to be mounted in a suspended ceiling and connected to the air supply duct of a ventilating system to diffuse air horizontally along the ceiling at an adjustable flow rate. An upper plate is designed to be supported on the rails of a suspended ceiling so as to be levelled with the ceiling tiles. A lower air deflecting plate is suspended from upper plates, the upper plate has a central hole for communicating with the air duct. Baffle plates are hinged to the underside of the upper plate along hinge axis which are parallel to and inwardly spaced from the free peripheral straight edges of the lower plate. The baffle plates can be manually adjusted and are maintained in an adjusted angular position between a fully-opened position in which they rest against the underside of the upper plate and a closed position with their free edges resting on the lower plate. Each baffle plate is independently angularly adjustable, such that the air can be discharged at adjustable volumes and selectively in various directions around the diffuser.

15 Claims, 4 Drawing Sheets

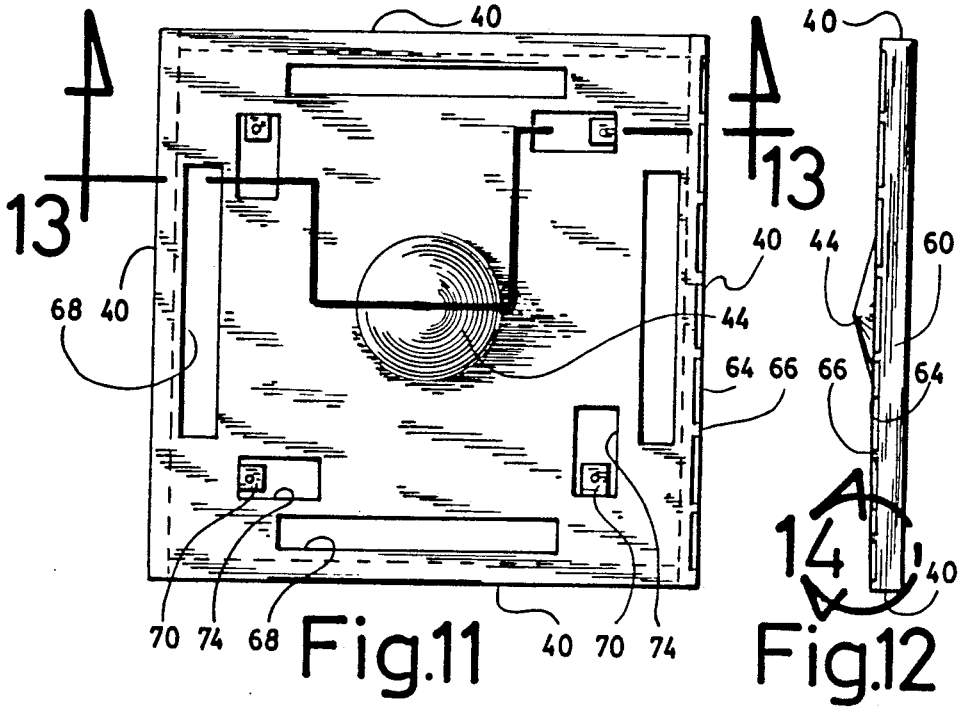
Fig.11
Fig.12
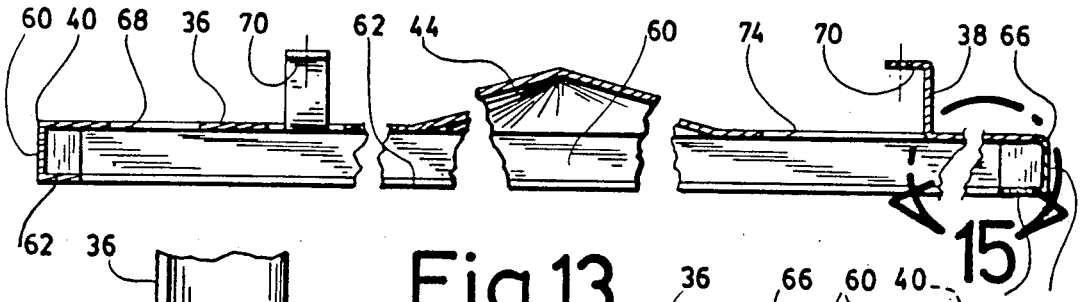
Fig.13
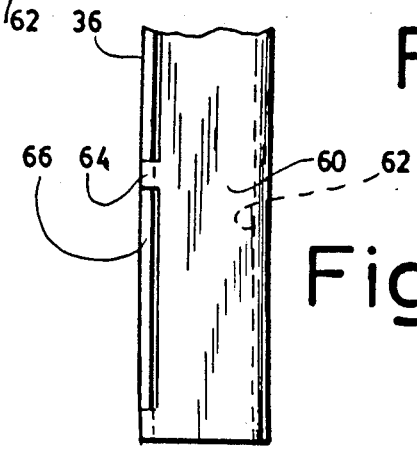
Fig.14
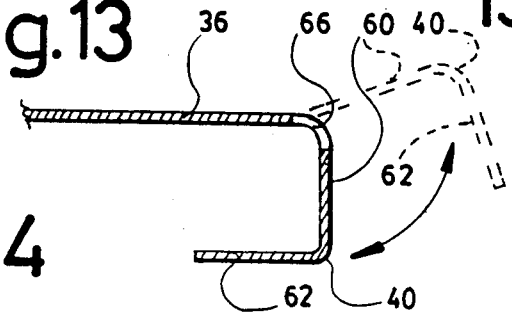
Fig.15

AIR DIFFUSER

FIELD OF THE INVENTION

This invention relates to ceiling mounted air diffusers, capable of air flow rate adjustment.

BACKGROUND OF THE INVENTION

Applicant's own prior U.S. Pat. No. 4,182,227, dated Jan. 8th, 1980, describes a ceiling mounted air-diffuser including an air-deflecting plate which is vertically adjustable below the ceiling level, so as to discharge air at an adjustable flow rate, horizontally along the ceiling. Also, means are provided to selectively vary the air flow rate, so as to obtain any desired directional flow pattern around the diffuser. One drawback of said known diffuser is the fact that its appearance varies in accordance with the adjusted vertical spacing of the air-deflecting plate from the celling, so that, when there are several air diffusers adjusted at various flow rates located in the same room, the room ceiling might be found unsightly.

U.S. Pat. No. 3,854,386 dated Dec. 17, 1974, entiled: AIR DIFFUSERS and issued to Allied Thermal Corporation, describes a ceiling mounted air diffuser in which the lower air-deflecting plate is set at a constant vertical spacing below the ceiling and in which air-flow rate adjustment is obtained by the provision of a large quantity of vertically-pivotable vanes, which makes the system difficult and time-consuming to adjust and in which the vanes are liable to produce a whistling sound when in nearly-closed position for minimum air-flow rate adjustment.

OBJECTS OF THE INVENTION

The main object of the present invention is to provide a ceiling-mounted air diffuser which is capable of providing a very large adjustment of the air-flow rate, for instance between 50 and 1000 cubic feet of air per minute, which is very silent in operation; and in which the lower air-deflecting plate remains at a constant vertical spacing below the ceiling.

Another object of the present invention is to provide an air diffuser of the character described, in which the directional air-flow pattern of the diffuser can be very easily and quickly adjusted all around the air diffuser.

Another object of the invention is to provide an air-flow diffuser of the character described, which is of simple and inexpensive construction; which can be easily taken apart for servicing of the air ventilation duct or other concealed parts of the air diffuser; and in which the adjustable baffle plates are concealed from view.

Another object of the present invention is to provide an air diffuser of the character described, which has means to retain thereunder a ceiling tile of the same type used for the remaining portions of the ceiling in which it is installed, so as to make the air diffuser as unobtrusive as possible.

Another object of the present invention is to provide an air diffuser made of sheet metal for respecting fire regulations and which can be mounted on the ceiling tile-supporting rails of a conventional suspended ceiling system.

SUMMARY OF THE INVENTION

The air diffuser of the invention is preferably made of sheet metal and comprises an upper polygonal plate, preferably having a pair of straight, generally parallel side edges, spaced apart a distance slightly smaller than the standard spacing between a pair of ceiling tile-supporting rails of a conventional suspended ceiling system, so as to be supported by said rails in lieu of a ceiling tile. Said upper plate has means to form a central hole of a selected size therein for installation of a connecting collar to be secured to an air supply duct. An air deflector lower plate is suspended from the upper plate in a position spaced from and below the upper plate to provide a peripheral gap of substantially uniform and constant width between the two plates. The lower plate is substantially co-extensive with the upper plate and is of the same polygonal shape, defining a plurality of substantially straight peripheral edges. There are as many substantially-rectangular baffle plates as the number of peripheral edges of said lower plate. Each baffle plate is located in the gap and has a free longitudnal edge and an opposite longitudinal edge which is hinged by hinge means to one of said upper and lower plates. The hinge axis of each baffle plate is substantially parallel to a related peripheral edge of the lower plate and is located inwardly of said peripheral edge. Each baffle plate has a width equal or greater than the width of said gap and is angularly adjustable in said gap between a fully-open position substantially parallel to said upper and lower plates, and a fully-closed position in which the free longitudinal edge of said baffle plate rests against the other one of said upper and lower plates. Preferably, when the baffle plate width is greater than the gap width, the end edges of said baffle plates are inclined with respect to said free longitudinal edges at an angle selected, so that the said end edges of adjacent baffle plates come practically in contact with each other when said baffle plates are in closed position. Means are provided to maintain each baffle plate in angularly-adjusted position. Preferably, the lower plate has an upwardly-extending central conical portion to smoothly deflect the air discharged through the hole of the upper plate. Preferably, the lower plate further includes retainer means at its peripheral edges to retain a ceiling panel in a lower plate concealing position against the lower side of said lower plate. Said retainer means preferably includes downwardly-depending flanges, each with an inturned lip disposed at the peripheral edges of said lower plate, spaced elongated slots extending along at least one peripheral edge of said lower plate to form easily bendable bridges which permit outward pivoting of the related flange to allow insertion and removal of the ceiling panel into and from its concealing position. The upper plate is preferably provided with a concentric set of closed marking lines in the center thereof, the lines of sizes corresponding to the sizes of a series of standard connecting collars used for connecting ventilation ducts of various sizes to the upper plate, said marking lines facilitating cutting a hole of the required size in the upper plate. Preferably, the baffle plates are co-extensive with each side of the diffuser. However, they can be transversely cut to form independently-adjustable baffle plate sections arranged in end-to-end relationship, so as to vary the air flow rate in a more precise manner in one selected direction with respect to the diffuser. Preferably, when the baffle plates are made of sheet metal, the hinge means for connecting the same to the upper or lower plate preferably consists of spaced tabs projecting from the hinged edge of the baffle plates and adhered flat against the underside of the upper plate. The bending resistance of these tabs along the hinge axis keep the baffle plates in angularly-adjusted position after having been manually set to the selected angles. The lower sheet metal plate is preferably provided with stamped-out tongues which can be upwardly bent to be removably secured by fasteners to the underside of the upper plate. The openings resulting from the stamping operation of the tongues permit easy access to the fasteners when it is desired to remove the lower plate for servicing of the air diffuser. The lower plate is preferably further provided with additional openings to make it lighter in weight and which also serves to gain access to the baffle plates to permit easy adjustment of the same once the concealing ceiling tile has been removed.

BRIEF DESCRIPTION OF THE DRAWINGS

In the annexed drawings:

FIG. 11 is a top plan view of the lower plate;

FIG. 12 is an end view of the lower plate;

FIG. 13 is a partial cross-section of the lower plate, taken on line 13—13 of FIG. 11;

FIG. 14 is a partial and elevation of the lower plate, taken within circle 14 of FIG. 12; and FIG. 15 is a partial cross-section of the lower plate, taken within circle 15 of FIG. 13.

In the drawings, like reference numerals indicate like elements throughout.

DETAILED DESCRIPTION OF A PREFERRED EMBODIMENT

Figure 1:
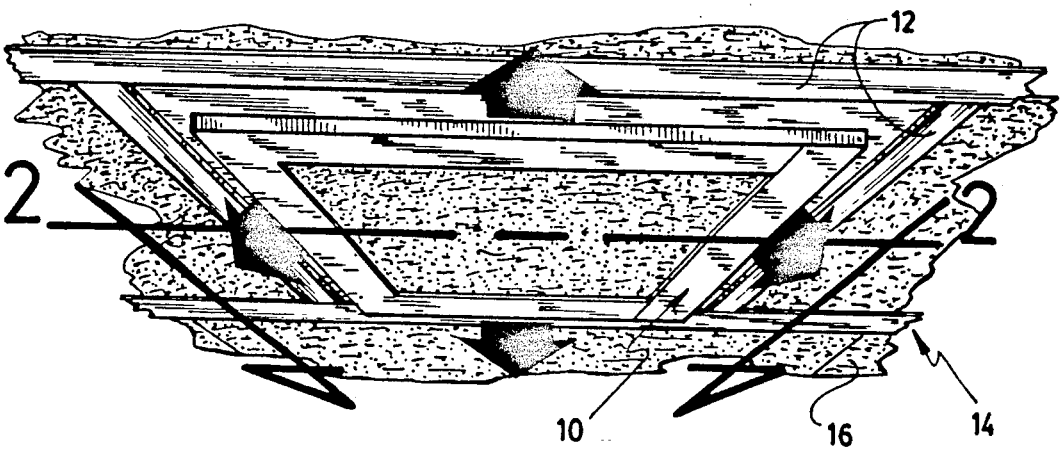
FIG. 1 is a perspective view looking at the underside of an air-diffuser in accordance with the invention, mounted in a suspended ceiling, which is partially shown.

The air diffuser of the present invention is generally indicated at 10. It is designed to be mounted in a ceiling, which can be any type of ceiling, for instance a dry wall ceiling, but the diffuser is preferably adapted to be removably supported by the conventional inverted T-shaped rails 12 of a suspended ceiling 14, said rails 12 normally supporting ceiling tiles 16. Air diffuser 10 is preferably made of sheet metal to comply with fire regulations of most urban areas. Air diffuser 10 includes an upper plate 18, of regular polygonal shape, preferably of square shape. The edges of the upper plate 18 are provided with upstanding flanges 20 to reinforce the upper plate. The upper plate is preferably of such a dimension as to rest on a pair of adjacent rails 12 to therefore support the air diffuser in a removable manner.

Figure 2:
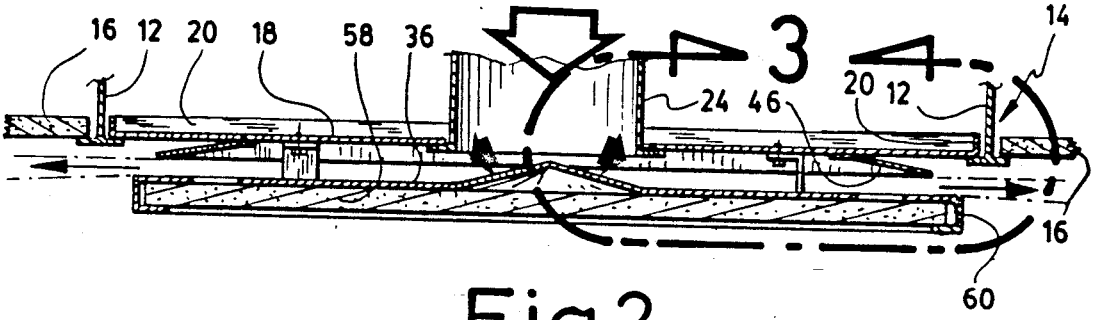
FIG. 2 is a vertical section, taken along line 2—2 of FIG. 1.
Figure 4:
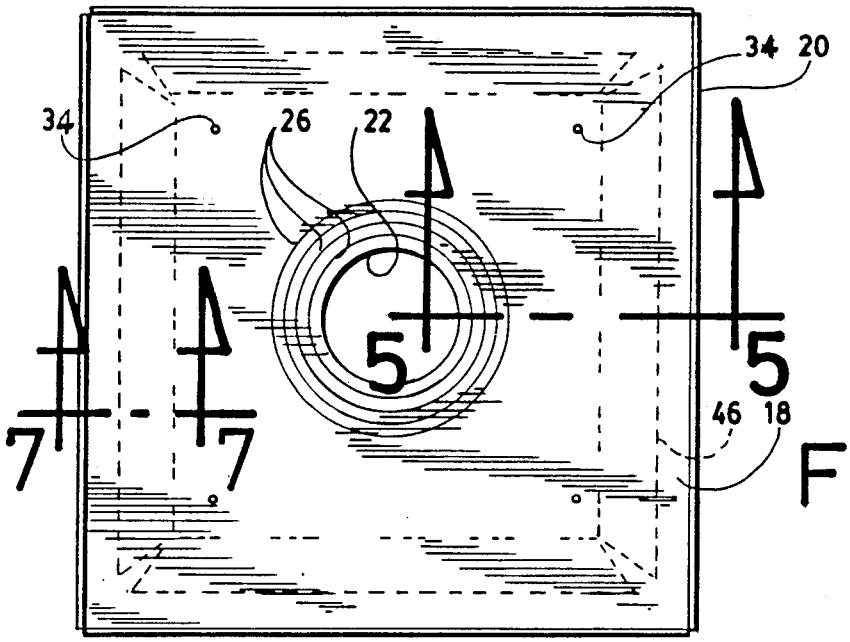
FIG. 4 is a top plan view of the air diffuser.

As shown in FIGS. 2 and 4, the upper plate 18 has a central hole 22, in which can be upwardly inserted a flanged collar 24 which is of standard construction and is intended to be snugly fitted within a standard air supply duct of a ventilation system, for instance an air supply duct of the flexible type. This duct is not shown since it forms no part of the invention.

Since the air diffuser of the invention is adapted to be connected to ventilation ducts of various diameters or sizes, a series of metal weakening and marking circular lines 26 are concentrically arranged around central hole 22, so that the sheet metal can be detached from any selected one of said marking lines 26 to provide a hole of the required size for the proper insertion of a flanged collar 24 of a size necessary to connect the air diffuser to the air supply duct of the required capacity.

Figure 5:
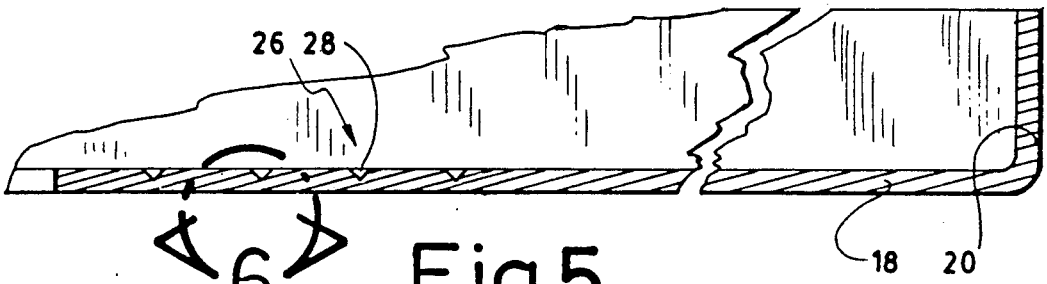
FIG. 5 is a partial vertical section of the upper plate, taken along line 5—5 of FIG. 4.
Figure 5A:
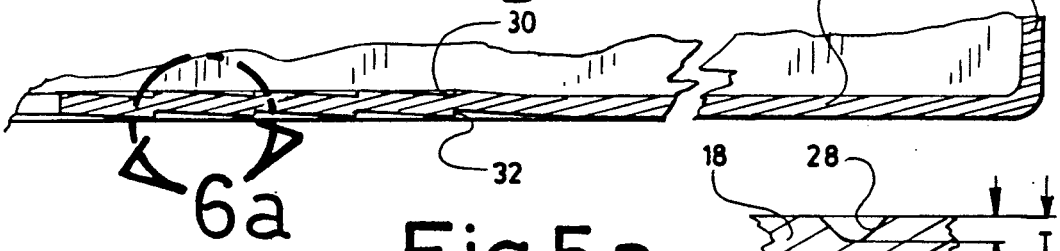
FIG. 5A is a partial vertical section, also taken along line 5—5 of FIG. 4, but showing an alternate embodiment of the weakening lines for cutting a central hole of the required size in the upper plate.
Figure 6:
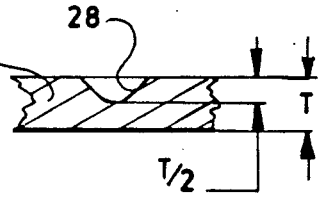
FIGS. 6 and 6A are enlarged partial sections of the portion encircled by lines 6 and 6A, respectively, in FIGS. 5 and 5A, respectively.
Figure 6A:
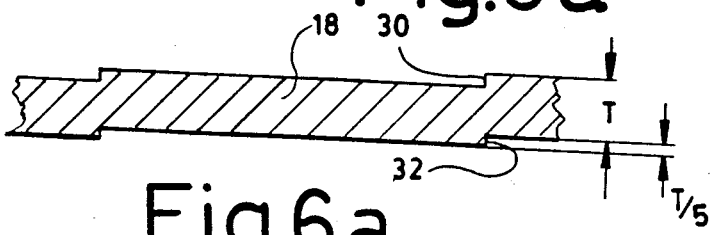
Figure 7:
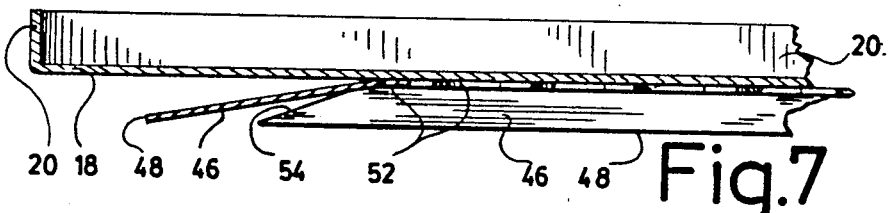
FIG. 7 is a cross-section of part of the upper plate and of the baffle plates, taken along line 7—7 of FIG. 4.

As shown in FIG. 5, the metal weakening of marking lines 26 can be provided by V-shaped grooves 28 made in the sheet metal of the upper plate, or can be provided by upsetting the sheet metal material to form steps 30, 32, as shown in FIG. 6*a*. The upsetting steps should preferably be of a height equal to one-fifth of the total thickness T of the sheet material. In the case of V-shaped grooves 28, the depth of these grooves should be half the total thickness T of the sheet material, as shown in FIG. 6. In this manner, the sheet material can be easily and quickly detached along the marking lines.

The upper plate 18 is further provided with four tapped holes 34 arranged at the four corners of an imaginary square symmetrical with respect to the upper plate 18.

A lower plate 36 is provided, which has the same polygonal shape as the upper plate, for instance a square shape, but of slightly smaller size. The lower plate 36 is designed to be suspended from the upper plate 18 by means of tongues or brackets 38, so as to be at a constant spacing from the upper plate and below the same, and arranged parallel thereto. The lower plate has a plurality of straight peripheral edges 40, which define a constant and uniform gap 42 with the upper plate 18.

In this particular embodiment, there are four peripheral edges 40 since the lower plate has the shape of a square. The central portion of the lower plate forms an upwardly-extending conical air-deflecting portion 44 which is in register with the central hole 22 of the upper plate 18. Thus, the air discharged from the air supply duct through the flange collar 24 and the central hole 22 is deflected horizontally in all radial directions by the lower deflecting plate 36 and its conical portion 44, so that the air will issue substantially horizontally in all directions and hug the underside of the ceiling due to the Coanda effect. Thus, cold air discharge is evenly distributed over a larger area before it falls down.

Figure 8:
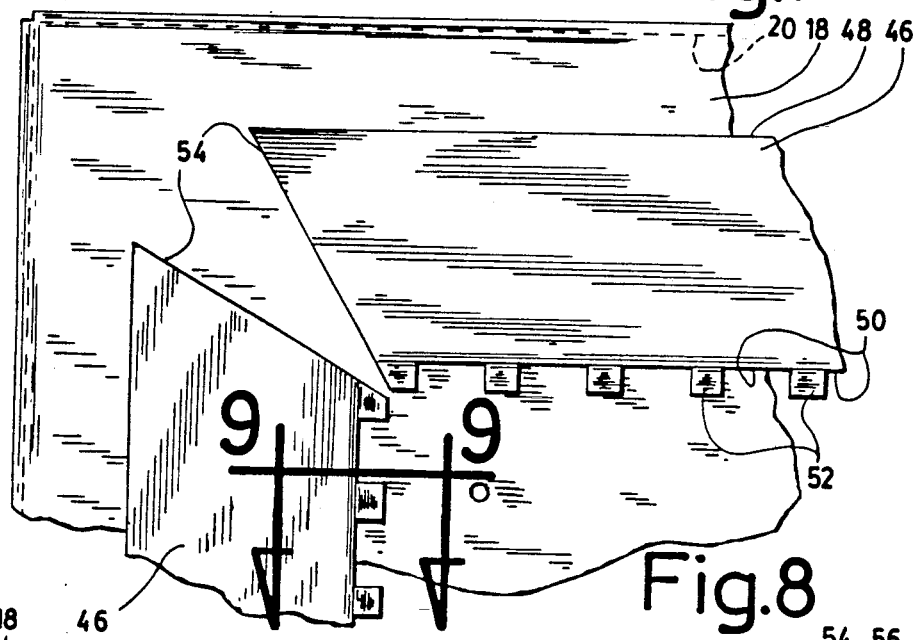
FIG. 8 is a partial view showing the underside of the upper plate and the baffle plates secured thereto, FIG. 8 being the portion encircled in circle line 8 of FIG. 10.
Figure 9:
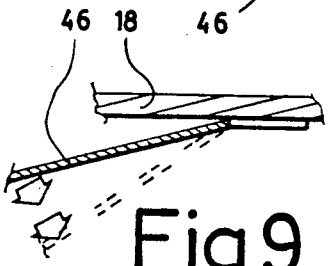
FIG. 9 is a partial cross-section, taken along line 9—9 of FIG. 8.
Figure 9A:
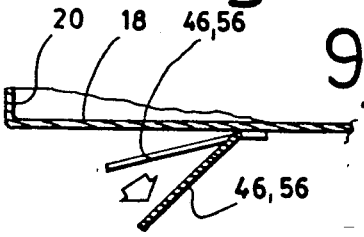
FIG. 9A is a partial section, taken along line 9A—9A of FIG. 10.
Figure 10:
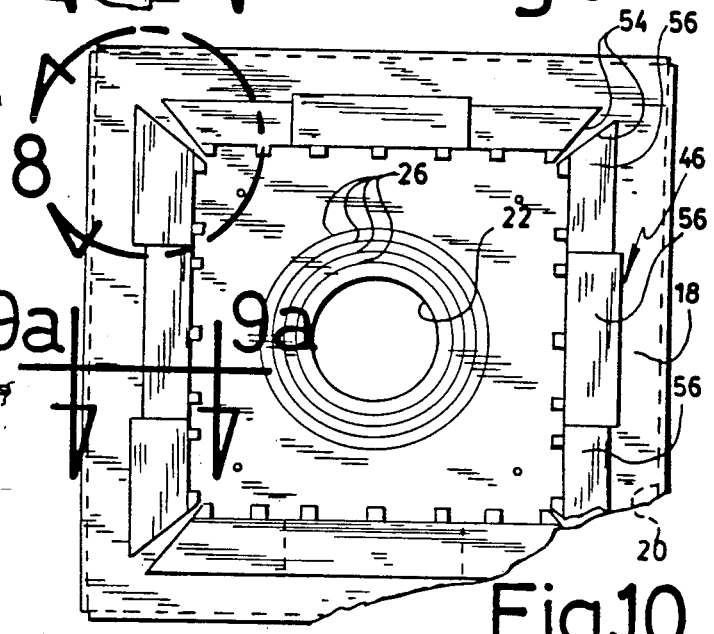
FIG. 10 is a plan view of the underside of the assembly of the upper plate and baffle plates.

As many baffle plates 46 are provided as there are peripheral edges 40 for the lower plate 36. In the present instance, there are four baffle plates 46, each associated with one peripheral edge 40. Each baffle plate 46 has a rectangular shape and has a width equal to or slightly greater than the width of the gap 42. Each baffle plate has a free longitudinal edge 48 and an opposite edge 50, which is a hinge edge. Along the hinge edge 30, there are provided a plurality of sheet metal extensions forming spaced tabs 52 which are integral with the baffle plate and which are adhered flat against the underside of the upper plate 18, such as spot welding, the tabs can bend along a bending line coincident with the hinge edge 50. The baffle plates 46 are attached by the tabs 52 to the underside of the upper plate 18 in such a manner that the hinge axis defined by the hinge edge 50 of each baffle plate is generally parallel to and inwardly positioned with respect to the associated peripheral edge 40 of the lower plate 36. Each baffle plate 46 can be manually angularly pivoted between a fully-opened position in which the baffle plate is flat against the underside of the upper plate 18, and a fully-closed position in which its free edge 48 rests on the top of the lower plate 36 in a vertical or inclined position. Only the closed inclined position is shown in the drawings. The baffle plates, once adjusted, remain in their adjusted inclined position due to the bending resistance of the tabs 52 along their bending lines. As shown in FIGS. 8 and 10, when the baffle plate width is greater than the gap width, the end edges 54 of each baffle plate is cut at an angle selected in such a way that, when two adjacent plates 46 are in fully-closed position, the end edges 54 of two adjacent baffle plates will come in substantial contact, so as to fully close the air diffuser. If it is not necessary to provide an air diffuser which stops air discharge practically completely, the end edges 54 can be perpendicular to the longitudinal edges of the baffle plates 46. For baffle plates which are vertical when closed, end edges 54 are also perpendicular to the longitudinal edges. From this, it is apparent that the same size air diffuser can be used to deliver air at various adjusted air flow rates. For instance, the same air diffuser can deliver anywhere between 50 and 1,000 cubic feet per minute, and this while keeping the lower plate at a constant position, namely by providing a gap 42 of constant width and also the baffle plates 46 are concealed from view for aesthetic purposes.

The directional pattern of the air flow can be varied by independently adjusting the angular position of each baffle plate 46. It is also possible to cut each baffle plate 46 to provide baffle plate sections 56 (see FIG. 10) arranged in end-to-end relation and each can be angularly adjusted independently of the other. Thus, the air flow pattern can be adjusted all around the diffuser and also on each side of the diffuser, in accordance with local conditions of the diffuser installation. In an alternate but less preferred embodiment, baffle plates 46 are hinged to the top side of lower plate 36 and their free edges 48 abut against the lower side of upper plate 18 when in closed position.

Figure 3:
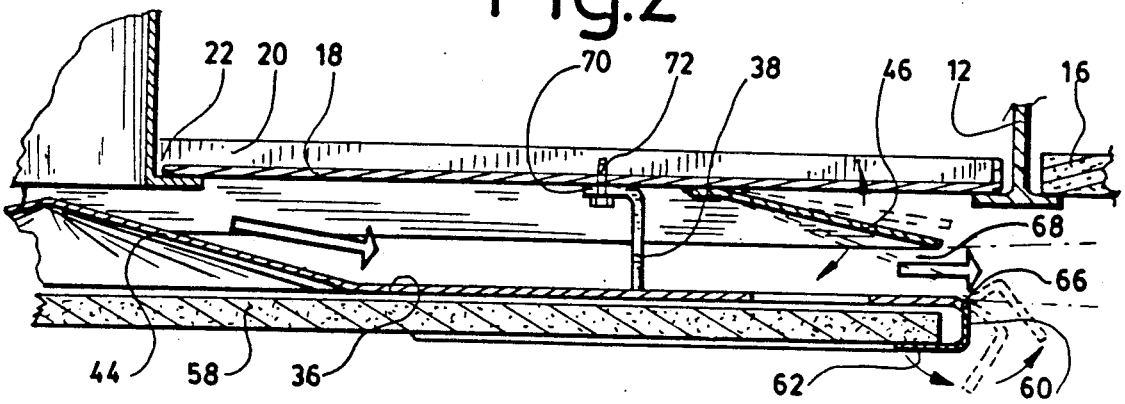
FIG. 3 is an enlarged partial cross-section of the part encircled within section line 3 of FIG. 2.

In order to better merge the air diffuser with the rest of the ceiling, a ceiling tile 58, of the same appearance and texture as the other ceiling tiles 16 of the suspended ceiling system, is retained against the underside of the lower plate 36 by retaining means, which preferably consist of a flange 60 downwardly depending from each of the peripheral edges 40 of the lower plate 36, each flange being provided at its lower edge with an inturned lip 62 on which the ceiling tile 58 can rest. To better facilitate insertion and removal of the ceiling tile 58 from its lower plate concealing position resting on the lips 62, at least one flange 60 is made pivotable to move between tile-retaining and tile-releasing position (see FIGS. 3 and 15). To that end, a plurality of spaced slots 64 are cut out along the pivotable flange to weaken the sheet metal material by providing narrow bridges 66, which can be easily bent back and forth.

Lower plate 36 (see FIG. 11) is provided with elongated openings 68, each extending along and parallel to the adjacent peripheral edge 40. These slots 68 serve to make the lower plate lighter and are also access openings for the insertion of one's fingers to adjust the angular position of the baffle plates 46 which register with these slots 68. Obviously, baffle plate adjustment is effected when the ceiling tile 58 is not in place.

The tongues 38, which serve to suspend the lower plate 36 from the upper plate 18, are preferably partially stamped out from the lower plate and bent to extend upwardly therefrom, and then bent again to provide a horizontal tab 70 which is fixed to the underside of the upper plate 18 by means of a metal screw 72, or the like fastener, which is screwed within the tapped hole 34 of the upper plate 18. Each stamped-out tongue 38 leaves a rectangular opening 74 within the upper plate 18, and this opening serves to gain access to the metal screw 72 for unscrewing the same if it becomes necessary to detach the lower plate from the upper plate, for instance if servicing of the flanged collar 24 or connected air supply duct becomes necessary.

Referring to FIG. 11, it is to be noted that the tongues 38, when in upright operative position, are successively at right angles to each other. This results from the stamping of the tongues and associated openings 74 successively aligned at right angles to each other around the square lower plate 36.

In this way, lateral stabilization of the lower plate 36 with respect to the upper plate 18 is obtained, namely the lower plate will resist much better any transverse force applied thereto.

It should be noted that flanged collar 24 need not be welded or otherwise adhered to the upper plate. This collar can be retained in place through the ventilation duct, which has a snug fit over the collar and which abuts the upper side of the upper plate 18.

From the foregoing, it is obvious that each baffle plate 46 can be quickly adjusted to obtain the desired air flow rate in any given direction. Also, since the baffle plates 46 are normally in one piece for each side of the air diffuser, adjustment need be repeated only four times in the case of a four-sided air diffuser. Thus, air-flow adjustment is very quick and simple to do. Also, the resulting construction is very simple and inexpensive. Experiments have demonstrated that no whistling sound is produced even when the baffle plates are adjusted for minimal air-flow rate.

I claim:

1. An air diffuser comprising an upper polygonal plate adapted to be horizontally positioned in a ceiling opening and provided with connector means to attach the same to an air supply duct which will discharge air through a central hole in said upper plate, an air deflector lower plate, suspension means suspending said lower plate in an horizontal position spaced below said upper plate to provide a peripheral gap of a substantially uniform width between the two plates, said lower plate subtantially co-extensive with said upper plate and of the same polygonal shape defining a plurality of substantially straight peripheral edges, as many substantially rectangular baffle plates as the number of peripheral edges of said lower plate, each baffle plate located in said gap having a free longitudinal edge and an opposite longitudinal hinge edge, hinge means hinging said baffle plates to one of said upper and lower plates, the hinge axis of each baffle plate being substantially parallel to a peripheral edge of said lower plate and located inwardly of said peripheral edge, each baffle plate angularly adjustable in said gap between a fully opened position substantially parallel to said upper and lower plates and a fully closed position in which the free longitudinal edge of said baffle plate rests against the other one of said upper and lower plates, and means to maintain each baffle plate in angularly adjusted position.

2. An air diffuser as defined in claim 1, wherein said lower plate forms a central generally conical air deflecting portion directed toward said upper plate.

3. An air diffuser as defined in claim 1, further including retainer means at the edges of said lower plate to retain a ceiling panel in a lower plate concealing position against the lower side of said lower plate.

4. An air diffuser as defined in claim 1, wherein said baffle plates can be transversely cut to provide independently adjustable baffle plate sections disposed in end to end relation.

5. An air diffuser as defined in claim 1, wherein said upper plate has a pair of straight generally parallel side edges spaced apart a distance slightly smaller than a pair of ceiling tile supporting rails of a suspended ceiling system so as to be supported thereby in lieu of a ceiling tile.

6. An air diffuser as defined in claim 1, wherein said baffle plates are hinged to said upper plate and their free edge comes to rest on said lower plate in said closed position.

7. An air diffuser as defined in claim 1, wherein all of said plates are made of sheet metal.

8. An air diffuser as defined in claim 7, further including means to form a central hole in said upper plate to receive a connecting collar adapted to be connected to an air supply duct.

9. An air diffuser as defined in claim 7, wherein said hinge means include spaced tabs projecting from said opposite longitudinal edge of said baffle plates and adhered flat against said one plate.

10. An air diffuser as defined in claim 6, wherein all of said plates are made of sheet metal and said hinge means includes spaced tabs projecting from said opposite longitudinal edge of said baffle plates and adhered flat against the underside of said upper plate, said hinge axis extending across said tabs along said opposite longitudinal edge, said means to maintain each baffle plate in angularly adjusted position consisting of the bending resistance of said tabs along said hinge axis.

11. An air diffuser as defined in claim 3, wherein all of said plates are made of sheet metal and said retainer means includes a depending flange with an internal lip at said peripheral edges of said lower plate and spaced elongated slots extend along at least one peripheral edge of said lower plate to form spaced intervening bridge positions of low resistance to bending which permit outward pivoting of the related flange to allow insertion and removal of said ceiling panel into and from its concealing position.

12. An air diffuser as defined in claim 1, wherein all of said plates are made of sheet metal and said suspension means include elongated tongues partially stamped out from said lower plate and integrally connected thereto at one end, said tongues upwardly extending and removably secured by fasteners to the underside of said upper plate, access to said fasteners being provided through the openings in said lower plate formed by the stamped upwardly extending tongues.

13. An air diffuser as defined in claim 12, wherein there are at least four such tongues stamped out at the corners of a theoretical square on said lower plate, adjacent tongues extending in planes normal to each other so as to better laterally stabilize said lower plate relative to said upper plate.

14. An air diffuser as defined in claim 7, further including means to form a central hole of a selected size in said upper plate, said means including a series of concentric closed marking lines in the center of said upper plate of respective sizes equal to the sizes of standard connecting collars used for connecting the air diffuser to the air supply duct, said marking lines providing sheet metal weakening to facilitate cutting of the sheet metal of said upper plate to form said central hole with the desired size and shape.

15. An air diffuser as defined in claim 1, wherein each baffle plate has a width slightly greater than the width of said gap and the end edges of said baffle plates make an angle with said longitudinal edges so that the end edges of adjacent baffles come practically in contact with each other when said baffles are in closed position.

* * * * *